US011786900B2

(12) United States Patent
Medoro et al.

(10) Patent No.: US 11,786,900 B2
(45) Date of Patent: Oct. 17, 2023

(54) MICROFLUIDIC DEVICE, MICROFLUIDIC SYSTEM AND METHOD FOR THE ISOLATION OF PARTICLES

(71) Applicant: Menarini Silicon Biosystems S.p.A., Castel Maggiore (IT)

(72) Inventors: Gianni Medoro, Casalecchio di Reno (IT); Alex Calanca, Mirandola (IT); Nicolò Manaresi, Bologna (IT)

(73) Assignee: Menarini Silicon Biosystems S.p.A., Castel Maggiore (IT)

( * ) Notice: Subject to any disclaimer, the term of this patent is extended or adjusted under 35 U.S.C. 154(b) by 113 days.

(21) Appl. No.: 16/342,923

(22) PCT Filed: Oct. 18, 2017

(86) PCT No.: PCT/IB2017/056481

§ 371 (c)(1),
(2) Date: Apr. 17, 2019

(87) PCT Pub. No.: WO2018/073767

PCT Pub. Date: Apr. 26, 2018

(65) Prior Publication Data

US 2020/0038870 A1 Feb. 6, 2020

(30) Foreign Application Priority Data

Oct. 18, 2016 (IT) ..... 102016000104612
Oct. 18, 2016 (IT) ..... 102016000104645

(51) Int. Cl.
*B01L 3/00* (2006.01)

(52) U.S. Cl.
CPC . *B01L 3/502761* (2013.01); *B01L 2200/0652* (2013.01); *B01L 2300/0663* (2013.01); *B01L 2300/0816* (2013.01)

(58) Field of Classification Search
CPC ..... B01L 3/502761; B01L 2200/0652
See application file for complete search history.

(56) References Cited

U.S. PATENT DOCUMENTS 7,485,454 B1 2/2009 Jury et al.
10,253,309 B2 4/2019 Han et al.
(Continued)

FOREIGN PATENT DOCUMENTS

CN 102427883 A 4/2012
CN 103055984 A 4/2013
(Continued)

OTHER PUBLICATIONS

International Search Report and Written Opinion, corresponding International application No. PCT/IB2017/056481, dated Jan. 4, 2018.

(Continued)

*Primary Examiner* — Caitlyn Mingyun Sun
(74) *Attorney, Agent, or Firm* — MARSHALL, GERSTEIN & BORUN LLP

(57) ABSTRACT

A microfluidic device for the isolation of particles of at least one specific type of a sample is described. The microfluidic device comprises: a first inlet adapted to receive a sample comprising the particles of the specific type, at least part of a separation group comprising a separation unit, which comprises a main chamber and a recovery chamber and being adapted to receive the sample and to transfer at least part of the particles of the specific type from the main chamber to the recovery chamber in a selective manner with respect to further particles of the sample, a first outlet which is designed to allow the particles of the specific type to be collected outside of the device and a second outlet adapted to allow at least a portion of the sample to flow out of the main chamber and out of the microfluidic device.

14 Claims, 4 Drawing Sheets

(56) References Cited

U.S. PATENT DOCUMENTS

| | | | | |
|---|---|---|---|---|
| 2011/0177547 | A1* | 7/2011 | Xia | G01N 1/34 73/863.61 |
| 2012/0184010 | A1* | 7/2012 | Medoro | B01L 3/502738 435/173.9 |
| 2012/0258459 | A1 | 10/2012 | Huang | |
| 2013/0043170 | A1 | 2/2013 | Rose et al. | |
| 2013/0114075 | A1 | 5/2013 | Hukari et al. | |
| 2013/0343966 | A1 | 12/2013 | Medoro et al. | |
| 2014/0034555 | A1 | 2/2014 | Foster et al. | |
| 2015/0126396 | A1* | 5/2015 | Manaresi | G01N 33/57423 435/7.1 |
| 2015/0198517 | A1 | 7/2015 | Simpson et al. | |
| 2015/0352544 | A1* | 12/2015 | Buermann | B01L 3/502715 435/6.12 |
| 2017/0010203 | A1 | 1/2017 | Otsuka et al. | |

FOREIGN PATENT DOCUMENTS

| | | | |
|---|---|---|---|
| CN | 103282127 | A | 9/2013 |
| CN | 105536898 | A | 5/2016 |
| CN | 105817276 | A | 8/2016 |
| CN | 105980059 | A | 9/2016 |
| EP | 2408562 | B1 | 3/2018 |
| KR | 2006-0111143 | A | 10/2006 |
| KR | 2012-0016199 | A | 2/2012 |
| KR | 2012-0026959 | A | 3/2012 |
| KR | 101250751 | B1 | 4/2013 |
| KR | 2014-0139548 | A | 12/2014 |
| WO | WO-00/69565 | A1 | 11/2000 |
| WO | WO-2007/010367 | A3 | 4/2007 |
| WO | WO-2007/049120 | A2 | 5/2007 |
| WO | WO-2007/110739 | A2 | 10/2007 |
| WO | WO-2010/106434 | A1 | 9/2010 |
| WO | WO-2012/085884 | A1 | 6/2012 |
| WO | WO-2013/138797 | A1 | 9/2013 |

OTHER PUBLICATIONS

PCT Direct Informal Comments filed in International application No. PCT/IB2017/056481 dated Oct. 18, 2017.

Office Action, Australian Patent Application No. 2017345507, dated Jun. 15, 2022.

Perroud, T. D. et al., 'Microfluidic-Based Cell Sorting of Francisella tularensis Infected Macrophages Using Optical Forces', Analytical Chemistry, vol. 80, No. 16, Aug. 15, 2008, pp. 6365-6372.

Office Action, Korean Patent Application No. 20197013714, dated Dec. 12, 2022.

* cited by examiner

MICROFLUIDIC DEVICE, MICROFLUIDIC SYSTEM AND METHOD FOR THE ISOLATION OF PARTICLES

CROSS-REFERENCE TO RELATED APPLICATION

This application is a U.S. National Stage of International Patent Application No. PCT/IB2017/056481 filed Oct. 18, 2017, which claims the benefit of priority of Italian Application No. 102016000104612 filed Oct. 18, 2016, and Italian Application No. 102016000104645 filed Oct. 18, 2016, the respective disclosures of which are each incorporated herein by reference in their entireties.

TECHNICAL FIELD

The present invention concerns a microfluidic device, a microfluidic system and a method for isolating particles of a sample, in particular a biological sample.

CONTEXT OF THE INVENTION

Systems for the isolation of particles of at least one specific type of a sample, in particular a biological sample in liquid form are known. These systems receive, in use, a sample comprising particles of the specific type and typically particles of one or more different types and are adapted to select and separate the particles of the specific type and the particles of the different type or types. Generally, these systems allow not only the isolation of the particles of the specific type belonging to a sample comprising also other types of particles, but also recognition of the various particles before their isolation.

These systems can be applied, for example, in the analysis of biological samples comprising tumour cells, foetal cells, stem cells or other types of cells.

A system of this type is described in EP-A-2408562 and comprises an analysis apparatus and a microfluidic device (in particular, a cartridge) for isolation of the particles of the specific type.

The microfluidic device for the isolation of particles, which is of the disposable type, is, in use, housed in the apparatus in a removable manner.

The microfluidic device is provided with a first inlet through which, in use, a sample comprising the particles is introduced into the microfluidic device, a separation unit, which comprises a main chamber and a recovery chamber fluidically connected to each other, and an inlet duct connected to the first inlet and to the main chamber.

In use, the particles of the specific type are transferred, in a selective manner with respect to particles of a different type, into the recovery chamber, which comprises a waiting area and a recovery area.

The device further comprises an outlet connected by means of an outlet duct to the recovery chamber, more specifically to the recovery area. In use, the particles of the specific type are discharged from the recovery chamber, more specifically from the recovery area and from the microfluidic device, through the first duct and the outlet.

The microfluidic device also comprises a second inlet, which is connected by means of a feeding duct to the recovery chamber and through which, in use, a flushing liquid is introduced into the recovery chamber.

The microfluidic device further comprises a collection reservoir connected to the main chamber and to the waiting area. A hydrophobic membrane is also provided arranged at a terminal portion of the collection reservoir, said membrane allowing outflow of the air present in the microfluidic device and, when intact, preventing outflow of the sample or of parts of the sample and/or of the sample.

Furthermore, the apparatus comprises a first pump, which is adapted to direct the sample through the inlet duct into the separation unit, and a second pump, which is adapted to direct the flushing liquid into the recovery chamber.

The system further comprises a recognition device having a fluorescence microscope, which allows the recognition of the types of particles and the determination of the relative positions, and an actuator device, which allows the particles to be moved according to the type of particles recognised by the recognition device so as to convey the particles of the specific type into the recovery chamber and maintain the particles of different type in the main chamber. More specifically, the actuator device is adapted to displace the particles by means of dielectrophoresis.

A microfluidic system of this type is described in EP-A-2408562 and does not allow (or allows only to a limited extent) the introduction of several successive portions of the sample into the separation unit. In particular, if there are large quantities of a sample, it is not possible to isolate all the particles of the specific type using one single microfluidic device; more than one device has to be used. This prolongs working times and increases costs.

A further drawback lies in the fact that a malfunction of the hydrophobic membrane (for example a rupture) can cause outflow of the sample from the microfluidic device, which may damage the apparatus and/or the system.

It should be further noted that when using the known microfluidic systems, it is not possible to recover the sample once it has been introduced into the microfluidic device.

The object of the present invention is to provide a microfluidic device, a microfluidic system and a method for the isolation of particles which overcome, at least partially, the drawbacks of the known art and are, at the same time, easy and inexpensive to produce.

SUMMARY

According to the present invention, a microfluidic device, a microfluidic system and a method for the isolation of particles are provided, as claimed in the following independent claims and, preferably, in any one of the claims depending directly or indirectly on the independent claims.

Unless explicitly specified otherwise, in this text the following terms have the meaning as indicated below.

By equivalent diameter of a section we mean the diameter of a circle having the same area as the section.

By microfluidic system we mean a system comprising at least one microfluidic duct and/or at least one microfluidic chamber. In particular, the microfluidic system comprises at least one pump (more specifically, a plurality of pumps), at least one valve assembly (more specifically, a plurality of valve assemblies) and if necessary at least one gasket (more specifically, a plurality of gaskets).

In the context of the present patent application, a reservoir can comprise a microfluidic duct, a microfluidic chamber or any combination thereof.

In particular, by microfluidic duct we mean a duct having a section with an equivalent diameter smaller than 0.5 mm.

In particular, the microfluidic chamber has a height of less than 0.5 mm. More specifically, the microfluidic chamber has a width and a length greater than the height (more precisely at least five times the height).

In the present text, by particle we mean a corpuscle having its largest dimension of less than 500 μm (advantageously less than 150 μm). Non-limiting examples of particles are: cells, cell debris (in particular, cell fragments), cell aggregates (e.g. small clusters of cells deriving from stem cells like neurospheres or mammospheres), bacteria, lipospheres, microspheres (in polystyrene and/or magnetic), complex nanospheres (e.g. nanospheres up to 100 nm) formed of microspheres bound to cells. Advantageously, the particles are cells.

According to some embodiments, the largest dimension of the particles (advantageously cells and/or cell debris) is smaller than 60 μm.

The dimensions of the particles can be measured in a standard way by microscopes with a graduated scale or normal microscopes used with slides (on which the particles are deposited) with a graduated scale.

In the present text, by dimensions of a particle we mean the length, width and thickness of the particle.

The term "selective" is used to identify a movement (or other analogous terms indicating a movement and/or a separation and/or a displacement) of particles, in which the particles that are moved and/or separated and/or displaced are particles largely of one or more specific types. Advantageously, a movement (or other analogous terms indicating a movement and/or a separation and/or a displacement) which is substantially selective entails moving particles with at least 90% (advantageously 95%) of particles of specific type/s (percentage given by the number of particles of the specific type/s with respect to the number of overall particles).

BRIEF DESCRIPTION OF THE FIGURES

The present invention will now be described with reference to the accompanying drawings, which illustrate a non-limiting example embodiment thereof, in which.

DETAILED DESCRIPTION

Figure 1:
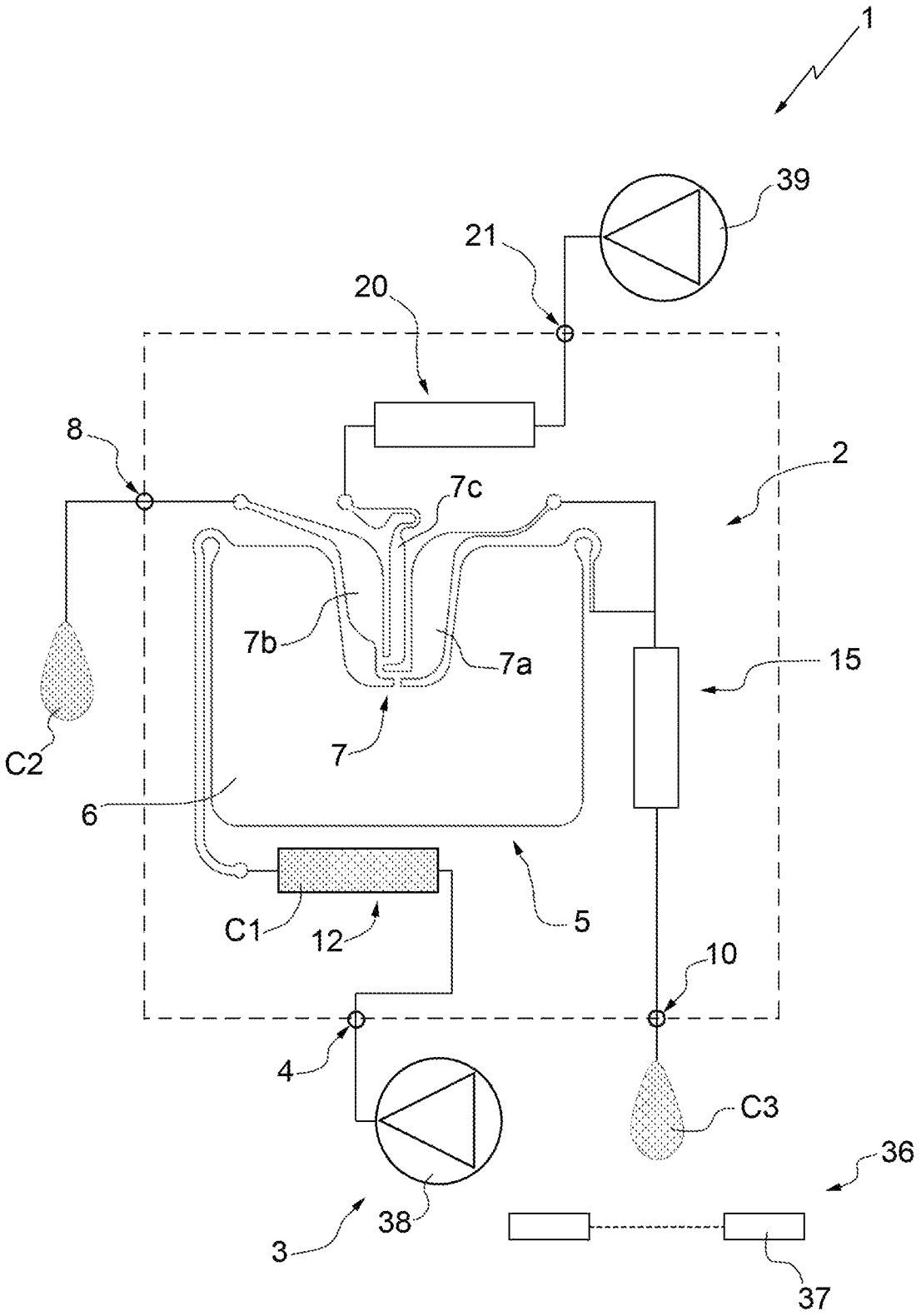
FIG. 1 schematically illustrates a system produced according to the present invention.

In FIG. 1, number 1 indicates schematically and overall a microfluidic system 1 for the isolation of particles of at least one specific type belonging to a sample C1. The system 1 comprises a microfluidic device 2 for the isolation of the particles of the specific type and an apparatus 3 (only partially illustrated) adapted to house the device 2, in particular in a removable manner, and to cooperate with the device 2 for isolation of the particles of specific type.

According to some non-limiting embodiments, the system 1 is adapted to isolate a specific type of particle. The system 1 can also be used for the isolation of different types of particles.

It should be noted that the sample typically comprises the particles of the specific type and at least one other type of particle. More precisely, the sample is a biological sample and, in particular, is a suspension of biological cells (for example cells).

In particular, the system 1 is adapted to isolate the particles of the specific type in a substantially selective manner with respect to the particles of the other type or other types. More specifically, the system 1 is adapted to isolate the particles of the specific type from the other type of particles so as to obtain a final sample C2 adapted to be further analysed, in particular by means of biological analysis.

Advantageously, the device 2 is a disposable cartridge.

Figure 2:
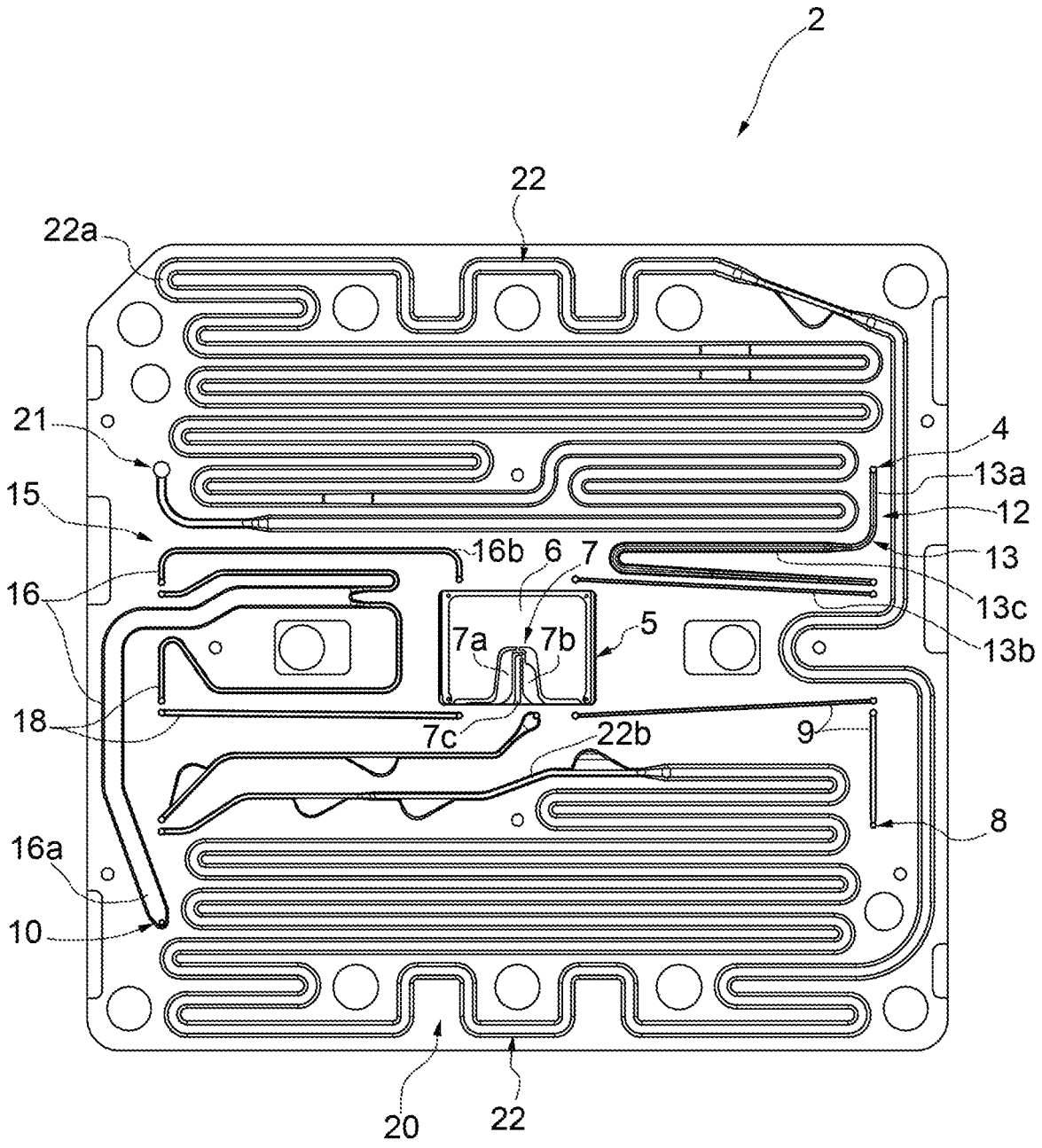
FIG. 2 is a view from above of a device of the system of FIG. 1.

With particular reference to FIGS. 1 and 2, and according to an aspect of the present invention, the device 2 comprises:

- a first inlet 4 adapted to receive the sample C1 comprising the particles of the specific type for introduction of the sample C1 into the device 2;
- a separation unit 5, which comprises a main chamber 6 and a recovery chamber 7 and is adapted to receive the sample C1 and to transfer at least part of the particles of the specific type from the main chamber 6 to the recovery chamber 7 in a substantially selective manner with respect to further particles of the sample C1; and
- a first outlet 8 (fluidically connected, in particular directly, to the chamber 7 and) configured to allow collection of the particles of the specific type, in particular in a final sample C2, outside of the device 2.

In greater detail, the chamber 7 of the unit 5 comprises a waiting area 7*a* and a recovery area 7*b* fluidically connected to each other and to the chamber 6. The area 7*b* is fluidically connected, in particular directly (i.e. without the interposition of further elements), to the outlet 8. In particular, the area 7*b* is arranged between the outlet 8 and the area 7*a*.

In further detail, the device 2 comprises an outlet duct 9 interposed between the chamber 7, in particular the area 7*b*, and the outlet 8.

Figures 4, 5:
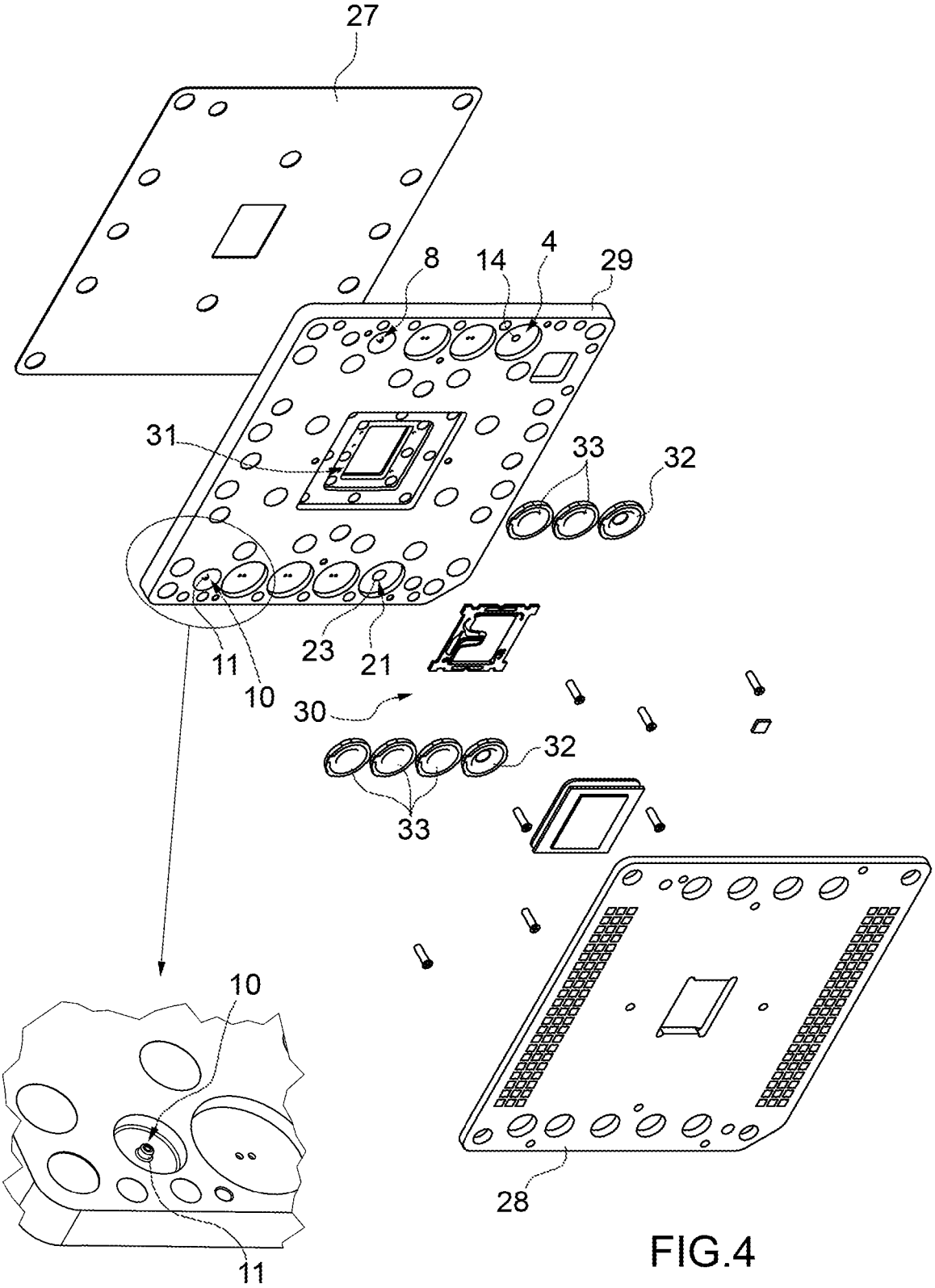
FIG. 4 is a view from below of an exploded drawing of the device of FIG. 2.
FIG. 5 is an enlarged view of a detail of FIG. 4.

Advantageously, the device 2 also comprises a second outlet 10, which is adapted to allow the outlet (of the sample C1 or) of a substance, in particular at least a portion C3 of the sample C1, from the main chamber 6 and from the device 2, in particular in a controlled manner. In particular, the outlet 10 is defined by an outlet nozzle 11 (see in particular FIG. 5).

According to some non-limiting embodiments, the device 2 further comprises a reservoir 12 for the sample fluidically connected to the inlet 4 and to the unit 5, in particular to the chamber 6. In particular, the reservoir 12 is arranged between the chamber 6 and the inlet 4.

More precisely, the reservoir 12 is adapted to receive the sample C1 from the inlet 4 and to direct the sample C1 towards the unit 5, in particular towards the chamber 6.

According to some non-limiting embodiments (like the one illustrated), the reservoir 12 comprises an inlet duct 13 fluidically connected to the inlet 4 and to the unit 5, in particular to the chamber 6. More specifically, the reservoir is formed from the duct 13. Preferably, the duct 13 comprises a feeding hole 14 at the inlet 4. Advantageously but not necessarily, the duct 13 has a curved configuration (i.e. provided with one or more bends). Furthermore, the duct 13 comprises an initial portion 13*a* directly connected to the inlet 4, a terminal portion 13*b* directly connected to the unit 5, in particular to the chamber 6, and an intermediate portion 13*c* arranged between the portions 13*a* and 13*b*. The portions 13*a*, 13*b* and 13*c* have sections with sizes substantially different from one another.

Advantageously but not necessarily, the device 2 also comprises a collection reservoir 15 adapted to fluidically connect the chamber 6 to the outlet 10. In particular, the reservoir 15 is arranged between the chamber 6 and the outlet 10.

In greater detail, the reservoir 15 is fluidically, in particular directly and fluidically, connected to the chamber 6 and is adapted to receive at least part of the sample C1, in particular at least the portion C3, from the chamber 6 and to direct the sample towards (to) the outlet 10.

More precisely, the reservoir 15 comprises, in particular is, a collection duct 16 connected to the chamber 6. Furthermore, the nozzle 11 is arranged at a final portion 16*a* of the collection duct 16. The duct 16 is connected to the chamber 6 at an initial portion 16*b* of the duct 16. The portions 16*a* and 16*b* are arranged at opposite ends of the duct 16. In some embodiments, the duct 16 has a curved configuration (i.e. provided with one or more bends).

According to alternative embodiments, the reservoir 15 is absent. In other words, the device 2 is without a reservoir arranged between the main chamber 6 and the outlet 10. In this way, the outflow of substance from the main chamber 6 is facilitated (by reducing the quantity of buffer required for the purpose). In particular, in these cases, only one duct 16 with small dimensions (relatively short) is arranged between the main chamber 6 and the outlet 10.

Advantageously but not necessarily, the device 2 also comprises a duct 18 adapted to fluidically connect the chamber 7, in particular the area 7*a*, to the outlet 10. In particular, the duct 18 is fluidically connected to the chamber 7, in particular to the area 7*a*, and to the duct 16.

In particular, the device 2 further comprises a reservoir 20 of flushing liquid fluidically connected to the chamber 7 and adapted to receive a flushing liquid, in particular a buffer. The device 2 also comprises a second inlet 21 adapted to receive the flushing liquid and to direct the flushing liquid to the reservoir 20. In particular, the reservoir 20 is arranged between the inlet 21 and the chamber 7.

In greater detail, the reservoir 20 of liquid is connected to a central area 7*c* of the chamber 7 interposed between the waiting area 7*a* and the recovery area 7*b*. The reservoir 20 comprises, in particular is, a feeding duct 22. The duct 22 has a second feeding hole 23 arranged at the inlet 21.

In particular, the reservoir 12 has a volume at least double (in some cases, at least triple) the volume of the chamber 6 (or of the sum of the volumes of the chambers 6 and 7).

Advantageously but not necessarily, the reservoir 20 has a volume at least double (in some cases, at least triple) the volume of the chamber 6 (or of the sum of the volumes of the chambers 6 and 7).

Furthermore, preferably, the duct 22 has a curved configuration (i.e. provided with one or more bends).

In further detail, the duct 22 comprises a main portion 22*a* and an auxiliary portion 22*b*; in particular, the portion 22*b* defines a final portion of the duct 22 directly connected to the chamber 7. In particular, the portion 22*a* has a diameter greater than the portion 22*b*. More precisely, the portion 22*a* has a section which is substantially greater than the respective sections of the ducts 9 and 13.

Figure 3:
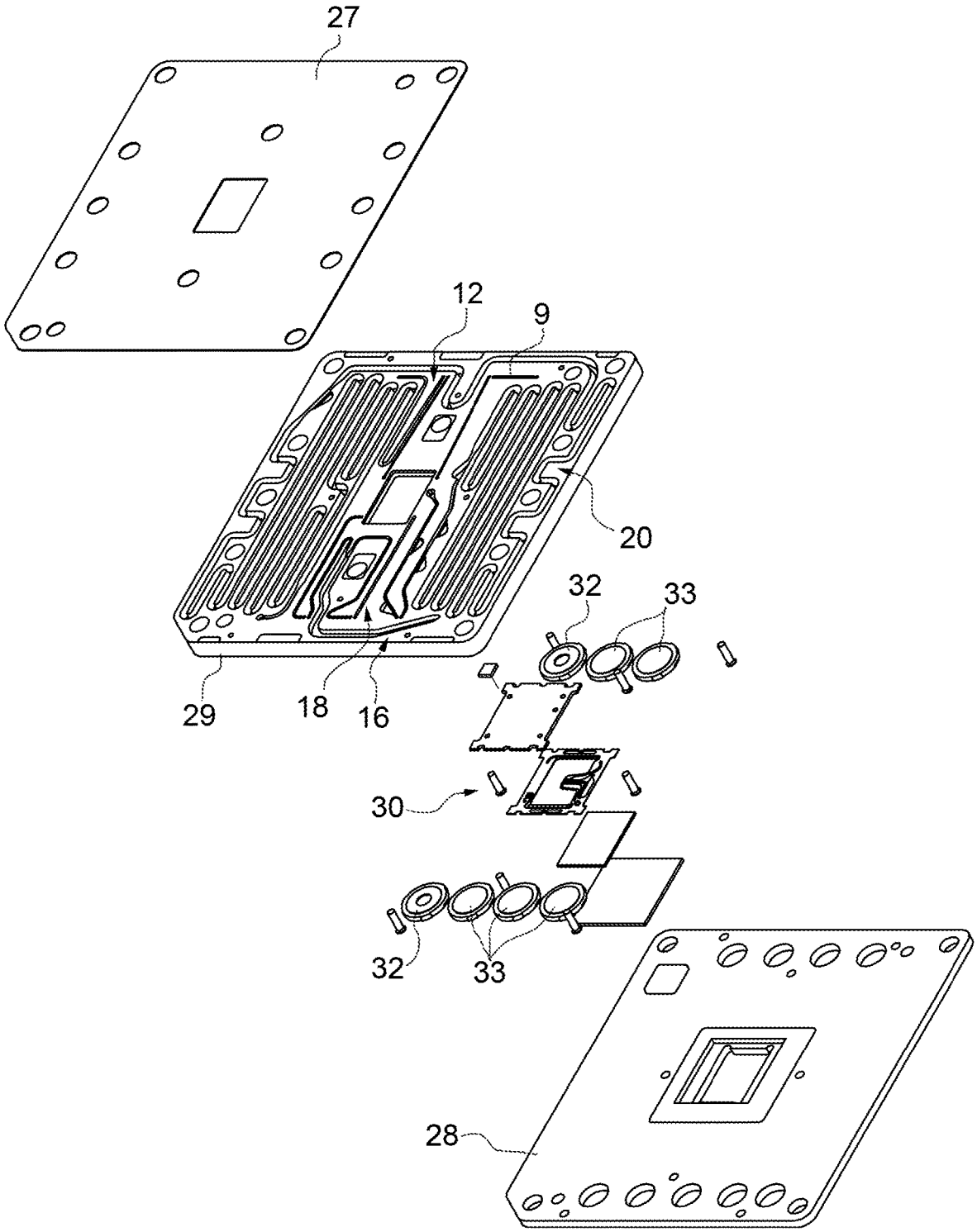
FIG. 3 is a view from above of an exploded drawing of the device of FIG. 2.

According to some embodiments (like the one illustrated in FIGS. 3 and 4), the device 2 comprises:

- an upper element 27, in particular made of COC (cyclic olefin copolymer) or a similar material;
- a support element 28, in particular made of COC (cyclic olefin copolymer) or a similar material or is a printed circuit; and
- an intermediate element 29, in particular made of polymethyl methacrylate (PMMA) or a similar material, interposed between the elements 27 and 28.

More precisely, the element 29 has on an own upper surface (visible in FIG. 3) at least part of the reservoirs 12, 15 and 20, and in particular part of the ducts 13, 16, 18, 22. The element 29 has on an own lower surface (visible in FIGS. 4 and 5) at least part of the outlets 8 and 10, at least part of the inlets 4 and 21, in particular part of the holes 14 and 23.

In particular, the device 2 further comprises at least part of a separation group 30, which comprises the unit 5. This part of the unit 30 is housed in a seat 31 of a housing of the element 29. According to some embodiments, the apparatus 3 comprises a further part of the separation group 30, in particular an actuator device. The system 1 comprises (therefore) the separation group 30.

According to one embodiment, the device 2 also comprises a plurality of seal elements 32, in this specific case two, in particular each having an annular shape. More specifically, one of the elements 32 surrounds the hole 14 and the other surrounds the hole 23.

According to one embodiment, the device 2 also comprises a plurality of closing elements 33, each adapted to collaborate with a respective duct 9, 13, 16, 18 or 21 and forming part of a valve assembly (not illustrated in further detail). Each element 33 can be selectively controlled between a closing position in which the respective element 33 fluidically closes the respective duct 9, 13, 16, 18 or 21 and an opening position in which the respective element 33 fluidically opens the respective duct 9, 13, 16, 18 and 21.

In further detail, one of the elements 33 collaborates with the duct 9 so as to selectively close or open the fluidic connection between the outlet 8 and the unit 5, in particular the chamber 7. Another element 33 collaborates with the duct 13 so as to selectively close or open the fluidic connection between the inlet 4 and the unit 5, in particular the chamber 6. Another element 33 collaborates with the duct 16 so as to selectively close or open the fluidic connection between the chamber 6 and the outlet 10. Another element 33 collaborates with the duct 18 so as to selectively close or open the fluidic connection between the chamber 7, in particular the area 7*a* and the outlet 10. A further element 33 collaborates with the duct 21 so as to selectively close or open the fluidic connection between the chamber 7 and the inlet 21.

Advantageously but not necessarily, with particular reference to FIG. 1, the system 1 (in particular, the apparatus 3) comprises a detection device 36 adapted to detect the outflow (in particular, the quantity) of a substance, in particular the sample C1 or at least the portion C3 of the sample C1, from the outlet 10.

More precisely, the detection device 36 comprises:

- a sensor 37 adapted to detect single drops of the substance, in particular the sample C1 or at least the portion C3 of the sample C1 which, in use, flows out of the outlet 10, in particular which flows out of the outlet 10 in a controlled manner; and
- a calculation unit (not illustrated and known per se) adapted to determine the quantity of the substance (in particular of the sample C1 or at least of the portion C3 of the sample C1) which flows out of the outlet 10 according to the number of single drops detected by the sensor 37.

It should be noted that the single drops have a predefined volume (in particular known) which substantially depends on the nozzle 11 (and on the liquid). Each drop has substantially the same volume as the others.

Preferably, the apparatus 3 also comprises a housing (not illustrated and known per se) to house the device 2 in a removable manner.

In particular, the apparatus 3 further comprises pressure means 38 (more precisely, a pump and/or a reservoir of gas under pressure) adapted to direct the sample from the reservoir 12 to the separation unit 5.

In addition or alternatively, according to some non-limiting embodiments, the system 1 comprises a sensor 37 adapted to detect the passage of a liquid (in particular, of the sample) from the outlet 10, and a control system (not illustrated and known per se—if necessary comprising the above-mentioned calculation unit) connected to the sensor 37 and adapted to control the pressure means 38 according to the parameters detected by the sensor 37. In particular, the control system is adapted to stop the operation of the pressure means 38 when, in use, the sensor 37 detects the passage of liquid.

In addition or alternatively, the apparatus 3 also comprises pressure means 39 (more precisely, a pump and/or a reservoir of gas under pressure) adapted to direct the flushing liquid from the reservoir 20 to the unit 5, in particular directly into the chamber 7.

According to some embodiments, the system 1 (more precisely, the apparatus 3) comprises a recognition device (not illustrated and known per se) adapted to determine the position and type of particles present in the separation unit 5.

Advantageously but not necessarily, the recognition device is defined by an apparatus with an optical microscope adapted to obtain an image in fluorescence and/or in bright field to detect the type and positioning of the single particles present in the unit 5. In particular, the apparatus with microscope is configured to stimulate selective fluorescence markers with which the particles are labelled and to detect the position of the labelled particles in the unit 5 on the basis of the fluorescence signal received.

Advantageously but not necessarily, the system 1 (more precisely, the separation group 30) comprises the actuator device adapted to move the particles of the specific type from the chamber 6 to the chamber 7, in particular after the introduction of at least one fraction of the sample C1 into the unit 5, in particular into the chamber 6. More precisely, the actuator device selectively interacts with the specific type particles (with respect to the other particles).

In greater detail, the actuator device is adapted to actuate the displacement of (i.e. the movement of) the particles of the specific type from the chamber 6 to the chamber 7 in static conditions. In other words, the actuator device is adapted to displace the particles whereas the sample introduced into the unit 5, in particular the chamber 6, is not subject to hydrodynamic movements (flows).

According to some advantageous and non-limiting embodiments, the separation group 30 (in particular, the actuator device) comprises a system able to exert a force directly on the particles of the specific type (in particular, without the force being exerted on the fluid which transfers the movement to the particles of specific type).

The separation group 30 (in particular, the actuator device) is adapted to carry out the selective movement of each particle by means of magnetophoresis, dielectrophoresis, acoustic waves (acoustophoresis) and/or optical manipulation (optical tweezers). According to specific embodiments, the separation group 30 (in particular, the actuator device) comprises a dielectrophoresis unit (or system) as described for example in at least one of the patent applications WO-A-0069565, WO-A-2007010367, WO-A-2007049120, the contents of which are here referred to in full for completeness of description (incorporated for reference). In particular, the unit 5 comprises a part of the dielectrophoresis unit (or system). More specifically, the unit 5 (group 30) operates according to what is described in the patent applications with publication number WO2010/106434 and WO2012/085884).

In use, before insertion of the device 2 into the apparatus 3, the device 2 is loaded with the sample C1 and, preferably, also with the flushing liquid. In particular, the sample C1 is inserted through the inlet 4 into the reservoir 12. More specifically, the sample C1 is inserted in the duct 13 by means of the hole 14.

Furthermore, prior to insertion of the device 2 into the apparatus 3, the flushing liquid (in particular a buffer solution) is introduced into the device 2 through the inlet 21. More precisely, the flushing liquid is introduced into the reservoir 20. More specifically, the flushing liquid is introduced into the duct 22 by means of the hole 23.

After loading the sample C1 and preferably the flushing liquid into the device 2, the device 2 is inserted into the apparatus 3, in particular the device 2 is inserted into the housing of the apparatus 3.

At this point, during an introduction phase, at least one fraction of the sample C1 is inserted into the unit 5. In particular, a fraction of the sample C1 is transferred from the reservoir 12 (in particular, from the duct 13) to the unit 5, in particular to the chamber 6. More specifically, the fraction of the sample C1 is introduced by operation of the pressure means 38.

At this point, in particular, after the introduction phase, during at least one selection phase, the particles of the specific type are transferred into the chamber 7 in a substantially selective manner with respect to further particles of the sample, in particular by means of a system selected from the group consisting of: dielectrophoresis, optical tweezers, magnetophoresis, acoustophoresis and a combination thereof.

Advantageously but not necessarily, during the selection phase, distribution of the particles in the unit 5 is determined, in particular by means of the recognition device. More specifically, the position and type of each particle is determined. Even more specifically, the particles of the specific type are optically identified on the basis of fluorescent signals (an image is captured or several fluorescence images are captured).

More specifically, this occurs by activation of the actuator device substantially as described in the patent applications WO-A-0069565, WO-A-2007010367 and WO-A-2007049120.

More specifically, the particles of the specific type are positioned in the area 7*a* of the chamber 7. Typically, particles of other types are maintained in the chamber 6. Subsequently, in particular prior to a discharge phase of the particles of specific type, the particles of the specific type are transferred to the area 7*b*.

According to some non-limiting embodiments, at least one repetition phase is performed during which the introduction phase and the selection phase are repeated. In particular, a further fraction of the sample C1 is introduced from the reservoir 12, in particular from the duct 13, into the unit 5. The particles of the specific type are then repositioned in the chamber 7, in particular in the area 7*a*.

In some cases, during the repetition phase, the discharge phase is also repeated. In this way it is possible to process a greater number of particles than the number that can be managed by the system 1; more precisely, in this way it is possible to process a greater number of particles than the number that can be contained in the waiting area 7*a*.

Advantageously but not necessarily, several repetition phases are performed so as to process all the sample C1 to obtain a final sample substantially comprising all the particles of the specific type originally present in the sample C1.

Furthermore, advantageously, during the repetition phases, fractions of the sample can flow out of the outlet 10 and are collected outside the device 2. Advantageously, but not necessarily, during the repetition phase or phases, while the further fraction of the sample C1 is introduced into the unit 5, at least a portion C3 of the sample flows out of the chamber 6 and the device 2 through the outlet 10. In particular, the portion C3 of the sample C1 is at least part of the fraction of the sample C1 introduced into the unit 5 in the preceding phase.

The repetition phase/s is/are particularly useful when the sample C1 contains a particularly high quantity of particles (and therefore has to be very diluted), more precisely, when the cells of interest are a very low percentage with respect to the total cells.

At least one discharge phase is also scheduled, during which the particles of the specific type are conveyed from the chamber 7 outside the device 2 through the outlet 8. In particular, the particles of the specific type are collected in the final sample C2 (which passes through the outlet 8). The particles contained in said final sample C2 subsequently undergo further analyses.

More specifically, the discharge phase is performed by introducing the flushing liquid into the chamber 7. In particular, the flushing liquid is transferred from the reservoir 20 (in particular, from the duct 22) into the chamber 7. More specifically, the pressure means 39 are operated to direct the flushing liquid from the duct 22 into the chamber 7.

In some cases, which entail several repetition phases, the discharge phase is performed only at the end of the (of all the) repetition phases.

In other cases, which entail several repetition phases, a respective discharge phase is performed at the end of each repetition phase (or at the end of a part of the repetition phases).

Advantageously but not necessarily, before each repetition phase an outflow phase is performed, in particular to remove the remaining fraction of the sample C1 in the chamber 6 from said chamber 6 (and to recover the remaining fraction of the sample outside the device 2).

In greater detail, during the outflow phase at least part of the sample is conveyed from the chamber 6 through the outlet 10 (and outside the device 2). In particular, during the outlet phase, the flushing liquid is introduced into the chamber 6. More specifically, during the outlet phase, the pressure means 39 are operated to direct the flushing liquid from the reservoir 20 through the (part of the) chamber 7 to the chamber 6.

Advantageously but not necessarily, the outflow phase is subsequent to the selection phase and prior to the discharge phase.

According to some embodiments, during the outlet phase, to convey at least part of the sample C1 through the outlet 10, a first fluid is caused to flow into the separation unit 5, entering into the (in particular, through the) main chamber 6 and a second fluid is caused to flow into the separation unit 5, entering into the (in particular, through the) recovery chamber 7.

In some cases, the system 1 comprises a reservoir 12, which is fluidically connected to the separation unit 5 at (in particular, through) the main chamber 6 and is in particular adapted to contain the sample; and pressure means 38, adapted to direct a first fluid from the reservoir 12 into the main chamber 6. The system 1 further comprises a second reservoir 20, which is fluidically connected to the separation unit 5 at the (in particular, through the) recovery chamber 7 and is in particular adapted to contain a flushing liquid; and pressure means 39, adapted to direct a second fluid from the second reservoir 20 into the main chamber 6. In these cases, during the outflow phase, the pressure means 38 and 39 are operated.

It should be noted that in the embodiment illustrated in the figures (in particular, see FIG. 2), the reservoir 12 has relatively small dimensions. To perform one or more repetition phases, the reservoir 12 has a different shape and (above all) a significantly higher containment capacity (volume) than the reservoir 12 illustrated.

In particular, the reservoir 12 has a volume at least twice (in some cases, at least three times) the volume of the chamber 6 (or of the sum of the volumes of chambers 6 and 7).

According to some non-limiting embodiments, during the selection phase, the particles of the specific type are optically identified on the basis of fluorescent signals (coming from the particles).

It should be noted that, according to the present invention, important advantages are obtained with respect to the state of the art. In particular, it is underlined that the presence of the second outlet 10, in particular of the nozzle 11, allows recovery of the sample C1 or at least of the portion C3 of the sample C1. This is particularly advantageous considering that the sample C1 is difficult to recover and that it has a high value. In particular, in some application cases the sample C1 serves to diagnose serious illnesses. The loss of samples could, therefore, result in very negative consequences for the patients.

Furthermore, also in the case of a malfunction of the device 2 which does not allow the isolation of the specific particles, the device 2 is able to recover all (or almost all) the sample C1. Subsequently, it is therefore possible to introduce the sample into a new device 2 in order to then isolate the particles of the specific type by means of the new device 2.

A further advantage lies in the fact that, due to the presence of the second outlet 10 and, therefore, the possibility of repeating the introduction and selection phases several times, it is possible to obtain a final sample substantially comprising all the particles of the specific type also in samples containing a high number of particles, in particular when the sample has a low percentage of particles of interest with respect to the total particles (for example below 1/1000) and/or when it is necessary to obtain a high number of particles of interest.

Furthermore, the hydrophobic membrane has been eliminated and with it, also the possible problem of an undesired and uncontrolled outflow of a fraction of the sample C1 or of another substance from the device 2 due to rupture of the hydrophobic membrane.

Unless explicitly indicated otherwise, the contents of the references (articles, books, patent applications etc.) cited in this text are referred to here in full. In particular the above-mentioned references are incorporated here for reference.

The invention claimed is:

1. A method for the isolation of particles of at least one specific type belonging to a sample by using a microfluidic device comprising a first inlet adapted to receive the sample and allow the sample to be introduced into the microfluidic device, at least part of a separation group comprising a separation unit, which comprises a main chamber and a recovery chamber and being adapted to receive the sample and to transfer at least part of the particles of the at least one specific type from the main chamber to the recovery chamber in a selective manner with respect to other particles of the sample; a first outlet in fluid communication with the recovery chamber, the first outlet being configured to allow the particles of the at least one specific type to be collected outside of the microfluidic device from the recovery chamber, the separation group comprising an actuator device adapted to actuate movement of the particles of the at least one specific type from the main chamber to the recovery chamber, the microfluidic device comprising a second outlet in fluid communication with the main chamber and distinct from the first inlet, the second outlet comprising a nozzle adapted to allow at least a portion of the sample to flow out of the main chamber and out of the microfluidic device, the method comprising:

at least one introduction phase, during which a first fraction of the sample is introduced into the separation unit;

at least one selection phase, during which the at least part of the particles of the at least one specific type are moved to the recovery chamber in the selective manner with respect to further particles of the sample;

at least one repetition phase, during which the at least one introduction phase is repeated to introduce a second fraction of the sample, and the at least one selection phase is repeated;

at least one outflow phase, the at least one outflow phase comprising flowing an outflow fluid through the separation unit such that the outflow fluid enters the separation unit through the main chamber and is flowed through the main chamber and through the nozzle of the second outlet, and at least one discharge phase, during which the particles of the at least one specific type are conveyed from the recovery chamber through the first outlet to the outside of the microfluidic device, wherein during the at least one selection phase the actuator device moves the particles of the at least one specific type from the main chamber to the recovery chamber.

2. The method according to claim 1, wherein during the at least one selection phase, the at least part of the particles of the at least one specific type are moved by means of a system chosen from the group consisting of: dielectrophoresis, optical manipulation, magnetophoresis, acoustic waves and a combination thereof.

3. The method according to claim 1 wherein, during the at least one repetition phase, the at least one discharge phase is repeated.

4. The method according to claim 3, comprising several repetition phases; the at least one discharge phase being performed only at the end of all the repetition phases.

5. The method according to claim 1 wherein, during the at least one selection phase, the particles of the at least one specific type are optically identified on the basis of fluorescent signals.

6. The method according to claim 1, further comprising wherein the at least one outflow phase is performed during the at least one repetition phase.

7. The method according to claim 6, wherein during the at least one repetition phase, while a further fraction of the sample is introduced into the separation unit, the portion of the sample that flows out of the main chamber and out of the microfluidic device through the second outlet during the at least one outflow phase is a portion of the first fraction of the sample.

8. The method according to claim 1, wherein the recovery chamber comprises a waiting area and a recovery area; during the at least one selection phase, the particles of the at least one specific type are arranged in the waiting area; the particles of the at least one specific type are also directed from the waiting area to the recovery area prior to the at least one discharge phase.

9. The method according to claim 8 wherein, during the at least one repetition phase, the particles of the at least one specific type are arranged in the waiting area; and at the end of the at least one repetition phase and before the at least one discharge phase, the particles are moved from the waiting area to the recovery area.

10. The method according to claim 1 wherein, during the at least one discharge phase, a flushing liquid is introduced into the recovery chamber.

11. The method according to claim 1, wherein the outflow phase is subsequent to the at least one selection phase and prior to the at least one discharge phase.

12. The method according to claim 1, during the at least one outflow phase, in order to move at least part of the sample through the second outlet, the outflow fluid is caused to flow into the separation unit entering through the main chamber as a first fluid, and a second fluid is caused to flow into the separation unit entering through the recovery chamber.

13. The method of claim 1, during the at least one outflow phase the outflow fluid is flowed from a reservoir fluidically coupled to the main chamber enters the separation unit from the reservoir through the main chamber.

14. A method for the isolation of particles of at least one specific type belonging to a sample by using a microfluidic device comprising a first inlet adapted to receive the sample and allow the sample to be introduced into the microfluidic device, at least part of a separation group comprising a separation unit, which comprises a main chamber and a recovery chamber and being adapted to receive the sample and to transfer at least part of the particles of the at least one specific type from the main chamber to the recovery chamber in a selective manner with respect to other particles of the sample; a first outlet in fluid communication with the recovery chamber, the first outlet being configured to allow the particles of the at least one specific type to be collected outside of the microfluidic device from the recovery chamber, the separation group comprising an actuator device adapted to actuate movement of the particles of the at least one specific type from the main chamber to the recovery chamber, the microfluidic device comprising a second outlet in fluid communication with the main chamber and distinct from the first inlet, the second outlet comprising a nozzle adapted to allow at least a portion of the sample to flow out of the main chamber and out of the microfluidic device, the method comprising:

at least one introduction phase, during which a first fraction of the sample is introduced into the separation unit;

at least one selection phase, during which the at least part of the particles of the at least one specific type are moved to the recovery chamber in the selective manner with respect to further particles of the sample;

at least one repetition phase, during which the at least one introduction phase is repeated to introduce a second fraction of the sample, and the at least one selection phase is repeated;

at least one outflow phase, the at least one outflow phase comprising flowing an outflow fluid through the separation unit such that the outflow fluid enters the separation unit through the main chamber without intervening passage through the recovery chamber, and the outflow fluid is flowed through the main chamber and through the nozzle of the second outlet, and at least one discharge phase, during which the particles of the at least one specific type are conveyed from the recovery chamber through the first outlet to the outside of the microfluidic device, wherein during the at least one selection phase the actuator device moves the particles of the at least one specific type from the main chamber to the recovery chamber.

* * * * *